United States Patent [19]

Grasso

[11] 4,158,262

[45] Jun. 19, 1979

[54] ELECTRIC DRYER CONSTRUCTION FOR VEHICLE RADIATORS

[75] Inventor: James V. Grasso, Omaha, Nebr.

[73] Assignee: Inland Manufacturing Company, Omaha, Nebr.

[21] Appl. No.: 868,500

[22] Filed: Jan. 11, 1978

[51] Int. Cl.[2] ..... F26B 25/06

[52] U.S. Cl. ..... 34/202; 34/104

[58] Field of Search ..... 34/202, 210, 232, 235, 34/243 R, 104, 225; 432/224

[56] References Cited

U.S. PATENT DOCUMENTS

| | | | |
|---|---|---|---|
| 722,312 | 3/1903 | Mars | 34/104 X |
| 932,802 | 8/1909 | Morrill | 34/104 X |
| 2,340,206 | 1/1944 | Richards | 34/104 X |
| 2,351,482 | 6/1944 | Campbell | 34/104 |

FOREIGN PATENT DOCUMENTS

| | | | |
|---|---|---|---|
| 123769 | 10/1919 | United Kingdom | 34/104 |

*Primary Examiner*—Edward G. Favors

*Attorney, Agent, or Firm*—Allegretti, Newitt, Witcoff & McAndrews

[57] ABSTRACT

A dryer for engine radiators which simultaneously purges moisture from the internal tubes of the radiator and the external surface of the radiator. The dryer includes a cabinet divided into an enclosed dryer compartment and an adjacent compartment for housing mechanical components including a blower and heater. An access door is provided for positioning a radiator in the dryer compartment. The blower discharges heated air through a bifurcated duct into the interior of the dryer compartment and simultaneously into a manifold which is connected to a hose that attaches to the radiator within the compartment. Air and water exhaust passages are provided at the bottom of the dryer compartment.

9 Claims, 5 Drawing Figures

ELECTRIC DRYER CONSTRUCTION FOR VEHICLE RADIATORS

BACKGROUND OF THE INVENTION

This invention relates to an improved dryer apparatus and more particularly to a dryer device especially adapted to dry the interior and exterior passages of a radiator or heater core.

There are numerous radiator or heater cores associated with vehicle engines. A principal radiator is associated with the engine cooling system. Additional radiators may be associated with an automatic transmission or other hydraulic and liquid systems for a vehicle. From time to time, radiators require repair, cleaning or replacement, since, for example, tiny holes in the radiator tubes may impair the utility of the radiator. Quite often, it is economically desirable to repair the radiator rather than to replace it.

Repair necessitates cleaning and flushing of the radiator followed by soldering or welding of leaks. Prior to repair of leaks, however, the leaks must be located. To efficiently locate leaks, it has been found necessary to dry the internal radiator tubes and the external surface of the radiator before testing for leaks.

Various apparatus have been devised to clean and dry the radiator and expose leaks in the radiator. In the past, applicant's assignee has made radiator leak exposers and dryers including Inland Manufacturing Company Leak Exposer and Dryer Model No. 17 and Model No. 20. Typically, such dryer devices include a blower for directing air at or toward a radiator. A separate connection to the blower is provided so that air may be directed through the interior passages and channels or tubes forming the radiator.

After cleaning and drying the radiator, the usual method for locating leaks is to cap the radiator openings and force air into it while it is submerged under water. However, if the radiator tubes are wet on the inside, tiny droplets of water will coact to provide a surface tension effect which plugs tiny holes in the radiator. Thus, the fluid within the radiator may provide an effective seal preventing discovery of a leak.

To overcome this problem, it has been found advisable to dry the interior of the radiator prior to testing. The leak exposers of applicant's assignee discussed above provide such hot air to the interior of radiator tubes. Nonetheless, the prior art leak exposers do not quickly dry the interior of the radiator tubes. The present invention is an improved device for simultaneously and quickly drying both the interior tubes and exterior of a radiator.

SUMMARY OF THE INVENTION

Briefly, the present invention comprises an improved dryer for simultaneously drying the exterior and interior surfaces of a radiator. The dryer device is a cabinet which includes a dryer compartment for receipt of the radiator and a separate blower compartment for housing a blower, heater, manifold and controls. An access door is provided to the dryer compartment. A blower mounted in the blower compartment discharges heated air into dual passages one of which connects to the interior of the dryer compartment and the other of which connects to a manifold assembly. The manifold assembly includes one or more hose connections for attachment to a radiator which is positioned within the dryer compartment. Special structural features such as the floor construction and the support construction for the radiator within the dryer compartment facilitate the operation of the dryer device.

Thus, it is an object of the present invention to provide an improved dryer device, particularly adapted for use in drying radiators and similar articles.

Another object of the present invention is to provide a dryer which operates more efficiently than prior art radiator dryers.

Still another object of the present invention is to provide a dryer device which is of sturdy and economical construction and which can be easily manufactured and repaired as necessary.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
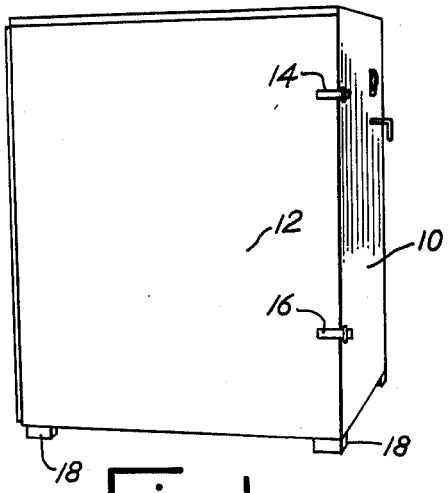
FIG. 1 is a perspective view of the improved dryer of the present invention.

FIG. 1 illustrates the general configuration of the improved dryer of the present invention. As shown in FIG. 1, a cabinet 10 is formed from sheet metal and includes a hinged access panel 12 maintained in a closed position by latches 14 and 16. The cabinet 10 is mounted on adjustable legs 18, though such mounting legs 18 are optional.

Figure 2:
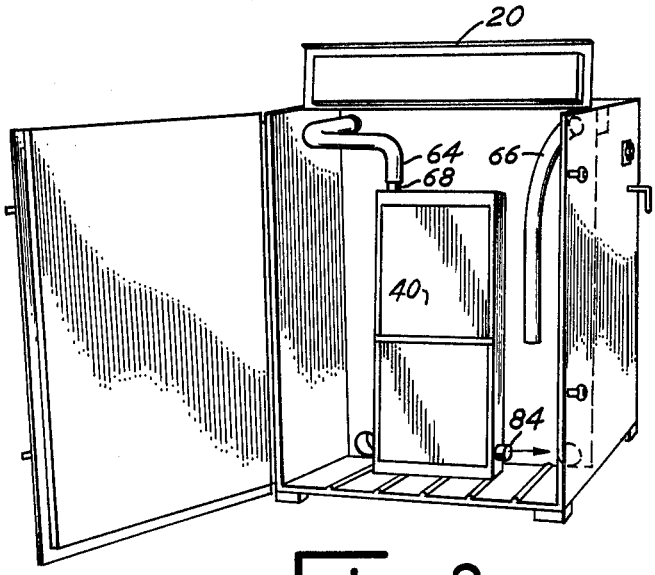
FIG. 2 is a perspective view of the dryer of FIG. 1 wherein the access panel or entry door to the dryer compartment has been opened and a radiator has been positioned in the dryer.
Figure 3:
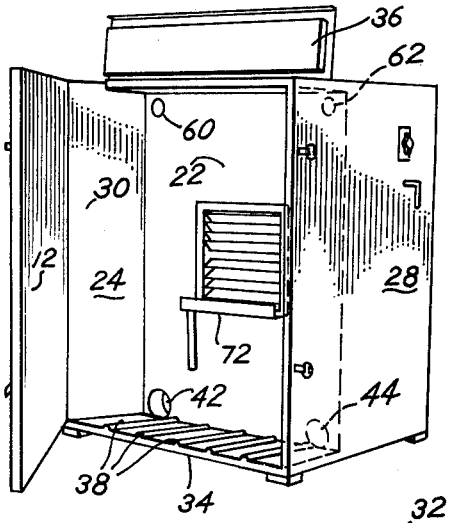
FIG. 3 is a perspective view similar to FIG. 2 wherein the access door and panel to the dryer compartment of the dryer have been opened.
Figure 4:
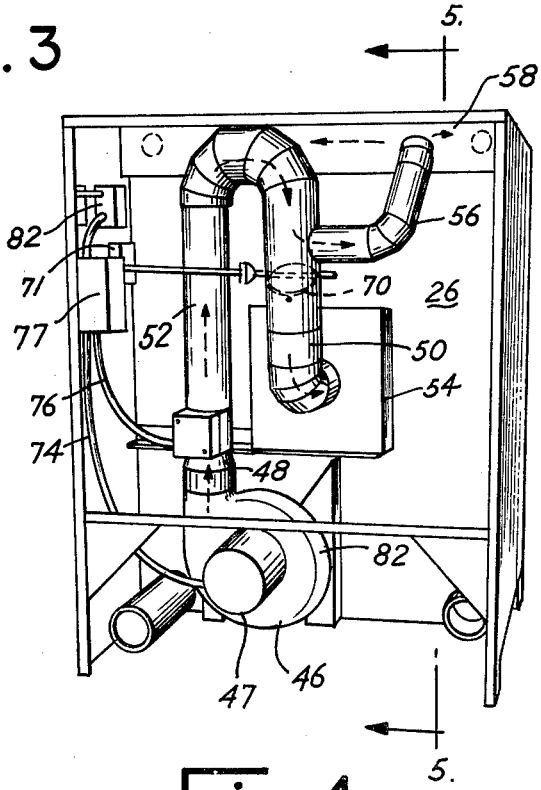
FIG. 4 is a rear perspective view of the improved dryer of the present invention.

Referring now to FIG. 2, the cabinet 10 also includes a pivotal top panel 20 which fits over the top edge of panel 12. As illustrated in the remaining figures, a substantially vertical wall 22 divides the cabinet 10 into two compartments, a forward or dryer compartment 24 and a rear or blower compartment 26.

Figure 5:
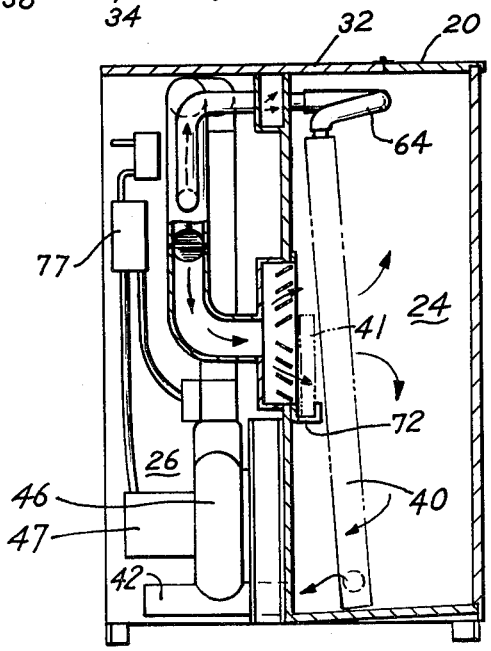
FIG. 5 is a cross-sectional view of the improved dryer of the present invention taken substantially along the line 5—5 in FIG. 4.

The dryer compartment 24 is substantially air tight and is formed by side walls 28 and 30, top panel 20 and top wall 32, bottom wall or floor 34 and the access panel or door 12. All of these panels or walls include heat and sound insulating material, for example, material 36 attached to the inside of top panel 20. The floor 34 is slightly inclined from the horizontal downwardly toward the vertical wall 32. A plurality of spaced support ledges or ribs 28 are defined on the floor 34 and are situated generally transverse to the wall 32. The ribs 38 support an article such as a radiator 40 above the floor 34 as shown in FIG. 5. This permits flow of air and excess water along the inclined floor 34 beneath the radiator 40.

Combination air and water discharge outlets 42 and 44 are defined at the bottom of the cabinet 10 in the vertical wall 22. Outlets 42 and 44 receive air and water flowing along the surface of floor 34 and discharge such air and water from the dryer compartment 24.

A blower 46 which is driven by an electric motor 47 is positioned in the blower compartment 26. Blower 46 discharges air through a discharge duct 48 into an electric heater duct 52. The heated air is then directed through a transfer duct 50 and a diffuser 54 to the interior of the dryer compartment 24. A portion of the air is directed by means of a second or bifurcated duct 56 into a manifold 58 at the top of the cabinet 10. Manifold 58 includes discharge outlets 60 and 62 connected to hoses 64 and 66 respectively. Each hose such as hose 64 is connected to radiator 40 at a radiator connector or inlet 68 as shown in FIG. 2. A damper control 70 is set to properly proportion the flow of air through ducts 50 and 56 to diffuser 54 and manifold 58 respectively. Damper 70 is controlled by manual damper control 71.

A horizontal support bar and shelf 72 is attached to the vertical wall 22 immediately adjacent the lower edge of diffuser 54. As shown in FIG. 5, the support shelf and bar 72 serves the principal function of support of a small radiator. The support shelf 72 is made from perforated metal to allow air to flow from diffuser 54 toward the bottom of radiator 40.

Power leads 74 and 76 from power control panel 77 connect respectively with the blower motor 47 and electric heater duct 52. Timer control 82 controls power supply to the heater duct 52 and blower motor 47.

In operation, air is drawn into the scroll of the blower 26, heated in the heater duct 52 and directed into the bifurcated ducts 50 and 56 downstream from the heater duct 52. One portion of the heated air exits through the diffuser 54 into the interior of the dryer compartment 24. Heated air passing through the diffuser 54 effectively drys the exterior surface of the radiator 40 by flowing back and forth within the dryer compartment 24 over the the surface of the radiator 40. Ultimately, the moisture-laden air is discharged through the outlets 42 and 44 along with any excess moisture collecting on the bottom of floor 34.

Another portion of the heated air passes through the duct 56, manifold 58, hose 64 and into the interior passages of the radiator 40. This air collects moisture from within the radiator and exits through an outlet 84 of the radiator 40 for ultimate discharge through the outlets 42 and 44. Maintaining Maintaining the radiator 40 within the dryer compartment 24 ensures extremely fast drying operation, thereby conserving energy. Additionally, there is great assurance that leak testing procedures of the dryed radiator will be effective.

The shelf 72 will support a second radiator (41 in FIG. 5) to permit simultaneous drying of two radiators 40, 41. In such an event, the separate hoses 64, 66 are connected to the separate radiators 40, 41. Consequently, the interior surfaces and exterior surfaces of both radiators can be dried at the same time.

While there has been set forth a preferred embodiment of the present invention, it is to be understood that the invention shall be limited only by the following claims and their equivalents.

What is claimed is:

1. An improved dryer device for simultaneously drying the exterior and interior of a radiator or similar article of the type having a fluid inlet connection and a fluid outlet connection to the interior, said dryer comprising, in combination:

a cabinet;

a substantially vertical interior cabinet wall subdividing the cabinet into two separate compartments, one of said compartments comprising an enclosed dryer compartment;

an access door in the cabinet to the dryer compartment;

a single blower in the other compartment;

a bifurcated duct from the blower having one passage to the dryer compartment for directing drying air into the compartment to dry the exterior of the article in the compartment and having a second passage to a manifold assembly, said manifold assembly including a manifold for receiving the drying air from the blower and at least one hose means from the manifold to the interior of the dryer compartment for attachment to an inlet connection of an article within the dryer compartment to thereby direct drying air into the interior of said article to dry the interior of said article; and at least one combination air and water discharge outlet at the bottom of the dryer compartment.

2. The improved device of claim 1 including a heater within the duct upstream from bifurcation of said duct into the two passages.

3. The improved device of claim 1 wherein the dryer compartment includes a bottom floor which is inclined from the horizontal downwardly toward the substantially vertical interior cabinet wall to thereby direct water discharge toward the outlet.

4. The improved device of claim 1 wherein the dryer compartment includes a lower floor having a plurality of substantially parallel article support ribs for supporting the article above the floor of the dryer compartment.

5. The improved device of claim 1 wherein the combination air and water discharge outlet is positioned at the bottom of the dryer compartment to receive water flow from the dryer floor.

6. The improved device of claim 1 wherein said manifold is positioned adjacent the top of said dryer compartment.

7. The improved device of claim 1 wherein said one passage directing drying air into the dryer compartment is positioned to direct air substantially into the middle region of the dryer compartment against the article within the compartment.

8. The improved device of claim 1 including a combination horizontal support bar and shelf member attached to the interior cabinet wall within the dryer compartment beneath the passage to the compartment for supporting a smaller radiator.

9. The improved device of claim 8 wherein said shelf member is perforated for air flow therethrough.

* * * * *